US008871698B2

(12) United States Patent
Podella et al.

(10) Patent No.: US 8,871,698 B2
(45) Date of Patent: Oct. 28, 2014

(54) CLEANING COMPOSITIONS AND METHODS FOR REDUCING BURNT-ON FOOD AND OIL RESIDUES

(75) Inventors: Carl W. Podella, Irvine, CA (US); Michael G. Goldfeld, Irvine, CA (US); Joseph F. Sarro, Irvine, CA (US); Andrew H. Michalow, Irvine, CA (US)

(73) Assignee: Advanced Biocatalytics Corporation, Irvine, CA (US)

( * ) Notice: Subject to any disclaimer, the term of this patent is extended or adjusted under 35 U.S.C. 154(b) by 0 days.

(21) Appl. No.: 13/148,304

(22) PCT Filed: Feb. 9, 2010

(86) PCT No.: PCT/US2010/023685

§ 371 (c)(1),
(2), (4) Date: Sep. 12, 2011

(87) PCT Pub. No.: WO2010/091433

PCT Pub. Date: Aug. 12, 2010

(65) Prior Publication Data

US 2012/0135909 A1 May 31, 2012

Related U.S. Application Data

(60) Provisional application No. 61/207,145, filed on Feb. 9, 2009, provisional application No. 61/207,146, filed on Feb. 9, 2009.

(51) Int. Cl.

| | |
|---|---|
| ***C11D 3/395*** | (2006.01) |
| ***C11D 3/48*** | (2006.01) |
| ***C11D 11/00*** | (2006.01) |
| ***C11D 3/20*** | (2006.01) |
| ***C11D 3/38*** | (2006.01) |

(52) U.S. Cl.

CPC ..... *C11D 3/2006* (2013.01); *C11D 11/0023* (2013.01); *C11D 3/2034* (2013.01); *C11D 3/381* (2013.01); *C11D 3/201* (2013.01)

USPC ..... 510/197; 510/235; 510/236; 510/237; 510/245; 510/367; 510/372

(58) Field of Classification Search

USPC ..... 510/197, 235, 236, 237, 245, 367, 372

See application file for complete search history.

(56) References Cited

U.S. PATENT DOCUMENTS

| | | | | |
|---|---|---|---|---|
| 2,552,347 | A | 5/1951 | Segura | |
| 3,890,165 | A | 6/1975 | Liao | |
| 5,102,573 | A | 4/1992 | Han et al. | |
| 5,306,355 | A | 4/1994 | Lagana | |
| 5,898,024 | A | 4/1999 | Talley | |
| 6,025,316 | A | 2/2000 | Cao et al. | |
| 6,043,207 | A | 3/2000 | Talley | |
| 6,046,150 | A * | 4/2000 | Choy et al. | 510/376 |
| 6,306,219 | B1 | 10/2001 | Ofosu-Asante et al. | |
| 6,348,107 | B1 | 2/2002 | Whitton et al. | |
| 6,465,405 | B1 | 10/2002 | Vitomir | |
| 6,479,445 | B1 | 11/2002 | Machac, Jr. et al. | |
| 6,586,380 | B2 | 7/2003 | Marquis et al. | |
| 6,624,132 | B1 | 9/2003 | Man et al. | |
| 6,699,391 | B2 | 3/2004 | Baldridge et al. | |
| 6,740,628 | B2 | 5/2004 | Bennie et al. | |
| 6,833,341 | B2 | 12/2004 | Machac, Jr. et al. | |
| 7,008,911 | B2 | 3/2006 | Griese et al. | |
| 7,165,561 | B2 | 1/2007 | Baldridge et al. | |
| 7,169,237 | B2 | 1/2007 | Wang et al. | |
| 7,476,529 | B2 * | 1/2009 | Podella et al. | 435/244 |
| 7,645,730 | B2 | 1/2010 | Baldridge et al. | |
| 7,658,848 | B2 | 2/2010 | Baldridge et al. | |
| 7,659,237 | B2 | 2/2010 | Baldridge et al. | |
| 2002/0035051 | A1 | 3/2002 | Alam et al. | |
| 2003/0078178 | A1 | 4/2003 | Ramirez et al. | |
| 2003/0162681 | A1 | 8/2003 | Hage et al. | |
| 2005/0049166 | A1 | 3/2005 | Huang | |
| 2005/0245414 | A1 * | 11/2005 | Baldridge et al. | 510/276 |
| 2006/0165613 | A1 | 7/2006 | Bjoernvad et al. | |
| 2006/0201877 | A1 | 9/2006 | Baldridge et al. | |
| 2006/0270583 | A1 * | 11/2006 | Baldridge et al. | 510/392 |
| 2008/0167445 | A1 * | 7/2008 | Podella et al. | 530/350 |
| 2009/0152196 | A1 | 6/2009 | Podella | |
| 2010/0099599 | A1 * | 4/2010 | Michalow et al. | 510/375 |
| 2010/0144583 | A1 * | 6/2010 | Baldridge et al. | 510/434 |

FOREIGN PATENT DOCUMENTS

| | | | |
|---|---|---|---|
| EP | 2393910 | A1 | 12/2011 |
| WO | 0149899 | A2 | 7/2001 |
| WO | 2010045603 | A1 | 4/2010 |
| WO | 2010091433 | A1 | 8/2010 |

OTHER PUBLICATIONS

International Search Report and Written Opinion issued in PCT/US2010/023685 dated Apr. 1, 2010.

The Extended European Search Report issued in EP 10739280 dated Mar. 20, 2013.

* cited by examiner

*Primary Examiner* — Charles Boyer

(74) *Attorney, Agent, or Firm* — Sam K. Tahmassebi; TechLaw LLP

(57) ABSTRACT

Disclosed herein are compositions comprising a solubilizing agent for the removal of burnt-on, cooked-on, baked-on, dried-on and charred organic food and oil residues from surfaces comprising alcohol, a coupling agent, water, an anti-deposition agent, a pH buffer and a surfactant system that preferably includes a fermentation supernatant, where the supernatant contains essentially stress proteins. Further enclosed are methods of cleaning for ovens, industrial cooking equipment and the like.

19 Claims, No Drawings

CLEANING COMPOSITIONS AND METHODS FOR REDUCING BURNT-ON FOOD AND OIL RESIDUES

RELATED APPLICATIONS

The present application is filed under 35 U.S.C. §371 as the U.S. national phase of International Application PCT/US2010/023685, filed Feb. 9, 2010, which designated the U.S. and claims priority to the U.S. Provisional Application Ser. No. 61/207,145, filed on Feb. 9, 2009 by Podella et al., and entitled "CLEANING COMPOSITIONS AND METHODS FOR BURNT-ON FOOD AND OIL RESIDUES," and to the U.S. Provisional Application Ser. No. 61/207,146, filed on Feb. 9, 2009 by Podella et al., and entitled "CLEANING COMPOSITIONS FOR BURNT-ON FOOD RESIDUES," the entire disclosure of both of which all of the above applications is incorporated by reference herein.

FIELD OF THE INVENTION

This invention relates to cleaning compositions and methods of removing baked-on, burnt-on, cooked-on, dried-on and charred organic food and oil residues, typically from cooking utensils, cooking equipment, deep fryers, hoods, ovens, rotisseries, cookware and the like.

BACKGROUND OF THE DISCLOSURE

Baked-on food or oil residue is notoriously difficult to clean. Traditionally, harsh cleaners have been employed to remove baked-on, burnt-on, cooked-on, dried-on and charred organic food residues. These cleaners are environmentally unsafe and damage the underlying surface to be cleaned. For example, the cleaners etch metal or glass surfaces or cause erosions.

Solutions comprising stress proteins are previously described, for example in U.S. Pat. Nos. 6,699,391, 7,165,561, 7,476,529, 7,645,730, 7,658,848, and 7,659,237, and U.S. Patent Application Publications Nos. U.S. 2006/0201877, U.S. 2008/0167445, and U.S. 2009/0152196, the entire disclosure of which is incorporated by reference herein. In particular, methods of producing stress proteins, such as heat-shock proteins or stress proteins produced as the result of chemical or mechanical stress, is disclosed in, for example, U.S. Pat. No. 7,645,730, column 4, line 63 to column 6, line 27, the specific disclosure is hereby incorporated by reference.

U.S. Pat. No. 7,008,911 involves cleaner/degreasers that are based on benzyl alcohol in water, coupled with compatibilizers such as 5-aminopentanol, and optionally use hydrogen peroxide, surfactants, enzymes and chelating agents.

U.S. Pat. No. 6,740,628 discloses methods for cleaning baked-on food residues with combinations of organic solvents including glycol ethers, and optionally uses surfactants and builders, and does not include the addition of hydrogen peroxide to augment the cleaning performance.

U.S. Pat. No. 5,102,573 discloses methods for treating baked-on food residues using a pre-treatment that comprises from 1 to 40% surfactant, carbonates, a choice of various glycol ethers, a mono-, di- or tri-ethanolamine, and does not include hydrogen peroxide.

U.S. Pat. Nos. 5,898,024 and 6,043,207 are related to cleaning compositions comprising peroxygen compounds, at high alkalinity preferably 9 to 12, with chelating agents and a metasilicate.

A number of patents disclose compositions comprising hydrogen peroxide, an alcohol (largely benzyl alcohol), water and other compounds including organic carbonates that are specifically designed for use in removing paint and coatings such as varnishes. U.S. Pat. Nos. 6,833,341 and 6,479,445 disclose paint stripping compositions and processes comprising an organic carbonate, preferably propylene carbonate, an alcohol such as benzyl alcohol, hydrogen peroxide, water and an activator such as an alkyl-substituted cycloalkane or choice of various soy oil derivatives.

U.S. Pat. No. 6,586,380 discloses compositions that remove paints and coatings, such as varnishes, that comprise benzyl alcohol, propylene carbonate, hydrogen peroxide and water and optional thickeners, organic co-solvents, ether esters, and methods that, after being applied, cause blistering or bubbling of paint or coating.

U.S. Pat. No. 6,348,107 is a method of stripping paint using a two-phase process with an aqueous phase comprising benzyl alcohol and optionally hydrogen peroxide and a second phase using an organic solvent.

U.S. Pat. No. 6,465,405 is related to a paint stripping composition comprising benzyl alcohol and malic acid, optionally comprising hydrogen peroxide.

SUMMARY OF THE INVENTION

Disclosed herein are compositions comprising an alcohol; at least one surfactant; and a protein component comprising proteins and polypeptides obtained from fermenting yeast cells and yeast stress proteins resulting from subjecting a mixture obtained from the yeast fermentation to stress. Also disclosed herein are compositions comprising at least one surfactant; an anti-deposition agent; and a protein component comprising proteins and polypeptides obtained from fermenting yeast cells and yeast stress proteins resulting from subjecting a mixture obtained from the yeast fermentation to stress. Further, disclosed herein are compositions comprising at least one surfactant and an anti-deposition agent. Methods of using the above compositions are disclosed for removing baked-on, burnt-on, cooked-on, dried-on or charred organic food or oil residues from a surface, the methods comprising applying to the surface the above compositions; and repeating the application as necessary; whereby the organic food or oil residue is substantially removed from the surface.

DETAILED DESCRIPTION OF THE EMBODIMENTS

Disclosed herein are cleaning compositions comprising at least one surfactant and a protein component. The protein component of the compositions disclosed herein comprises proteins obtained from the fermentation of yeast. In some embodiments, the protein component further coprises yeast stress proteins. As discussed below, yeast stress proteins are obtained when, at the conclusion of the fermentation process, the fermentation broth is subjected to stress, such as heat stress, chemical stress or mechanical stress. Yeast stress proteins are normally not obtained during the regular fermentation process. Instead, a separate stress step that delivers a shock to the yeast cells is required after the fermentation process is concluded.

The compositions disclosed herein have ingredients that are favorable for use in food contact applications, namely for the removal of baked-on, burnt-on, cooked-on and dried-on food and oil residues, collectively termed baked-on residues, and to reduce the reformation of the hardest to remove residues with subsequent use. In certain embodiments, the use of the compositions disclosed herein reduces the amount of harsh chemicals needed to maintain the cleanliness of cooking equipment to improve worker safety and extend the life of equipment. In another embodiment, the compositions can be made in a concentrate, to be diluted at the point of use. The use of the compositions disclosed herein controls odors in equipment, drains and sewer lines. Further, the presently disclosed compositions start the wastewater treatment process at the point of cleaning due to the uncoupling effect of the proteins on metabolic processes of resident microbe populations in drains and sewer lines.

The compositions disclosed herein are uniquely suited to clean baked-on or carbonized organic residues. In one aspect, the compositions are suited to clean the residues. In another aspect, in addition to cleaning, the compositions prevent or lessen the chance of future carbonization, where these compositions comprise an anti-deposition agent.

Cleaning Compositions

An aspect of the compositions disclosed herein is the cleaning effectiveness of baked-on residues at a relatively moderate pH. Thus, disclosed herein are compositions comprising: an alcohol; at least one surfactant; and a protein component comprising proteins and polypeptides obtained from fermenting yeast cells. In some embodiments, the protein component further comprises yeast stress proteins resulting from subjecting a mixture obtained from the yeast fermentation to stress.

In some embodiments, the alcohol is selected from the group consisting of methanol, ethanol, butanol and benzyl alcohol.

Traditionally, the compositions used to remove baked-on oils have been based on caustic cleaners that combine surfactants and/or solvents with caustic builders such as sodium hydroxide, to build pH levels to above 12. The high pH can be hazardous to the user as well as to the drains and equipment. Further, in institutional applications, regulatory requirements and safety risks of using highly caustic products raises the cost of disposal and use. Benzyl alcohol is an excellent solvent and has relatively low volatility with a vapor pressure of 0.15 mm Hg, low toxicity, contains no chlorine and occurs naturally in the environment and is rated at a bioconcentration factor of less than 100, which means it is not expected to bioaccumulate. Further, benzyl alcohol has relatively low volatility and flammability. The organic nature of the residues allows the alcohol to penetrate and help to soften the residues. In some embodiments, an alcohol level of 10% to 70% is used.

It was further noted that the compositions disclosed herein were more easily rinsed after cleaning, where the caustic cleaners tended to leave a white residue and were more difficult to rinse, a common side issue with highly alkaline cleaners that is termed "alkaline residue."

Anti-Adhesion Compositions

In one aspect, disclosed herein are compositions comprising: at least one surfactant; an anti-deposition agent; and a protein component comprising proteins and polypeptides obtained from fermenting yeast cells. In some embodiments, the protein component further comprises yeast stress proteins resulting from subjecting a mixture obtained from the yeast fermentation to stress.

In some embodiments, the anti-deposition agent is hydrogen peroxide. In certain embodiments, the anti-deposition agent is present in a concentration of between 0.01% to 12%. In other embodiments, the anti-deposition agent is present in a concentration of between 0.1% to 10%. In other embodiments, the anti-deposition agent is present in a concentration of between 1% to 8%. In other embodiments, the anti-deposition agent is present in a concentration of between 4% to 8%.

Hydrogen peroxide is used due to its strong oxidizing properties and that it breaks down quickly into water, leaving no residue, therefore posing little, if any, post-use or environmental hazards. Effective concentrations of hydrogen peroxide in the solutions are in the range of between 10% to 50%, and in some embodiments, in the range of between 20% and 35%. In some embodiments, the hydrogen peroxide is present in 30% concentration, or in 27% concentration. A 30% composition and a 27% composition were found to be effective as well, but the solubilizing agent was found to be more effective with lower levels of water. A number of stabilizing agents can be used for hydrogen peroxide including chelating agents such as polyphosphates, EDTA, and the like. In some embodiments, the hydrogen peroxide concentration of between 3% to 8%. In other embodiments, the concentration is between 4% to 5%.

The anti-deposition agent is particularly useful for cleaning baked-on residues for regularly used equipment such as institutional chicken rotisseries, industrial cooking equipment and where manual or mechanical abrasion is required. The anti-deposition feature is beneficial on stainless steel surfaces, reducing the amount of baked-on residue with subsequent regular use of the equipment, and thus simplifying cleaning process. Hydrogen peroxide is a preferred anti-deposition agent. Alternatively, acids such as citric acid can be used, which can also be used as a pH buffer, or can be used in combination with hydrogen peroxide.

The effectiveness of the hydrogen peroxide and surfactant cleaning composition is greatly enhanced by the addition of a fermentation supernatant, which contains stress proteins, as discussed in the below-referenced patents and patent applications of the current Assignee. The benefits of the addition of the proteins include reduced interfacial tension for improved wetting and penetration and lower critical micelle concentration, as well as the autocatalytic effect of creating surface active agents with the breakdown of oils.

In another aspect, disclosed herein are compositions comprising at least one surfactant and an anti-deposition agent. Thus, the compositions can be used effectively without the protein component. These compositions can further comprise an acid. In some embodiments, the acid is selected from the group consisting of citric acid, acetic acid, phosphoric acid, and sulfuric acid.

With continued use of the anti-adhesion compositions, the residue build-up can be controlled and minimized, and a less aggressive composition could be used in the cleaning process.

The composition creates a moderately acidic pH of about 4 due to the acidic effects of the hydrogen peroxide. Citric acid could be used as an alternate to, or in combination with, hydrogen peroxide to reduce deposition on stainless steel surfaces to reduce the formation of carbonization and caramelization during cooking cycles in ovens, rotisseries and the like.

Surfactants

In some embodiments, the at least one surfactant in the above compositions comprises a nonionic surfactant or an anionic surfactant. In certain embodiments, the surfactant comprises a mixture of several surfactants. In some of these embodiments, the mixture can comprise both nonionic and anionic surfactants. In some embodiments, the surfactant comprises a total surfactant concentration of from about 1% by weight to about 20% by weight. In some embodiments, the surfactant is selected from the group consisting of a C9-C11 or C10-C12 alcohol with 6 moles ethylene oxide, a C9-C11 with alcohol 2.5 moles ethylene oxide, a C10-C12 alcohol with 3 moles ethylene oxide, and dioctyl sulfosuccinate. Other suitable surfactants are disclosed in U.S. Pat. No. 7,645,730, column 6, line 41 to column 7, line 37, the particular disclosure being incorporated by reference herein.

A surfactant system improves wetting and penetration, preferably with the addition of the protein component to further reduce interfacial tension for improved wetting and penetration. The surfactant system is preferably improved by the addition of proteins as described in the above-incorporated patents and patent application publications, in particular the lowering of interfacial tension, which improves the ability of the cleaning composition to penetrate and wet the baked-on residues. A further benefit, at least in part due to the improved wetting, is improved rinsing of equipment, where caustic cleaners tend to leave a white residue and are more difficult to rinse. The applications listed above are not limiting and the compositions disclosed herein can be used in other related areas.

Surfactants that are useful in the compositions disclosed herein may be either nonionic, anionic, amphoteric or cationic, or a combination of any of the above, depending on the application. Suitable nonionic surfactants include alkanolamides, amine oxides, block polymers, ethoxylated primary and secondary alcohols, ethoxylated alkylphenols, ethoxylated fatty esters, sorbitan derivatives, glycerol esters, propoxylated and ethoxylated fatty acids, alcohols, and alkyl phenols, glycol esters, polymeric polysaccharides, sulfates and sulfonates of ethoxylated alkylphenols, and polymeric surfactants. Suitable anionic surfactants include ethoxylated amines and/or amides, sulfosuccinates and derivatives, sulfates of ethoxylated alcohols, sulfates of alcohols, sulfonates and sulfonic acid derivatives, phosphate esters, and polymeric surfactants. Suitable amphoteric surfactants include betaine derivatives. Suitable cationic surfactants include amine surfactants. Those skilled in the art will recognize that other and further surfactants are potentially useful in the enzyme/surfactant compound depending on the particular aqueous filtration application.

Protein Component

The protein component that is used in the compositions disclosed herein is obtained from the fermentation of yeast cells in the presence of a nutrient source. In certain embodiments, the plurality of yeast cells comprise one or more of *saccharomyces cerevisiae, kluyveromyces marxianus, kluyveromyces lactis, candida utilis, zygosaccharomyces, pichia*, or *hansanula.*

In some embodiments, the yeast cells are allowed to ferment to completion. The mixture that is obtained at the end of the fermentation process, which includes the cells, proteins, and other ingredients used in the fermentation process, is referred to as "broth". In some embodiments, the broth is used as the protein component in the compositions. In other embodiments, the broth is centrifuged to remove cells and cell debris and the supernatant is used without further purification. In yet other embodiments, the supernatant is run through a size exclusion column in order to remove either large proteins or small polypeptides.

In some embodiments, subsequent to the fermentation step, the broth is subjected to stress conditions, which can be heat stress, chemical stress, or mechanical stress.

In some embodiments, the nutrient source comprises a sugar, which can further comprise one or more of diastatic malt, diammonium phosphate, magnesium sulfate, ammonium sulfate zinc sulfate, and ammonia.

The present inventors have identified low molecular weight proteins and polypeptides from aerobic yeast fermentation processes which, when coupled with surfactants, reduce the critical micelle concentration, surface tension and interfacial tension of surfactants, with further reductions in the critical micelle concentration, surface tension, and interfacial tension observed after exposure to grease and oil.

The compositions disclosed herein comprise a yeast aerobic fermentation supernatant, surface-active agents and stabilizing agents. *Saccharomyces cerevisiae* is grown under aerobic conditions familiar to those skilled in the art, using a sugar source, such as molasses, or soybean, or corn, as the primary nutrient source. Alternative types of yeast that can be utilized in the fermentation process may include: *Kluyeromyces maxianus, Kluyeromyces lactus, Candida utilis* (Torula yeast), *Zygosaccharomyces, Pichia* and *Hansanula*. Those skilled in the art will recognize that other and further yeast strains are potentially useful in the fermentation and production of the low molecular weight proteins, "the protein system." It should be understood that these yeasts and the yeast classes described above are identified only as preferred materials and that this list is neither exclusive nor limiting of the compositions and methods described herein.

Additional nutrients can include diastatic malt, diammonium phosphate, magnesium sulfate, ammonium sulfate zinc sulfate, and ammonia. The yeast is propagated under continuous aeration and agitation between 30° C. and 35° C. and a pH range of between 5.2 and 5.6 until the yeast attains a minimum level of 4% based on dry weight. At the conclusion of the fermentation process, the yeast fermentation product is centrifuged to remove the yeast cells and the supernatant is then blended with surfactants and stabilizing agents and the pH adjusted to between 4.0 and 4.6 for long-term stability.

In an alternative embodiment, the yeast fermentation process is allowed to proceed until the desired level of yeast has been produced. Prior to centrifugation, the yeast in the fermentation product is subjected to autolysis by increasing the heat to between 40° C. and 60° C. for between 2 hours and 24 hours, followed by cooling to less than 25° C. and centrifugation.

In another embodiment, the fermentation process is allowed to proceed until the desired level of yeast has been produced. Prior to centrifugation, the yeast in the fermentation product is subjected to mechanical stress, e.g., physical disruption of the yeast cell walls through the use of a French Press, ball mill or high pressure homogenization, or other mechanical or chemical means familiar to those skilled in the art, to aid the release of the intracellular, low molecular weight polypeptides. It is preferable to complete the cell disruption process following a heating, or autolysis stage since the presence of the targeted proteins are induced by a heat-shock response. The fermentation is then centrifuged to remove the yeast cell debris and the supernatant is recovered.

In a third alternative embodiment, the fermentation process is allowed to proceed until the desired level of yeast has been produced. Following the fermentation process, the yeast cells are separated out by centrifugation. The yeast cells are then partially lysed by adding 2.5% to 10% of a surfactant to the separated yeast cell suspension (10%-20% solids). In order to diminish the protease activity in the yeast cells, 1 mM EDTA is added to the mixture. The cell suspension and surfactants are gently agitated at a temperature of about 25° C. to about 35° C. for approximately ne hour to cause partial lyses of the yeast cells. Cell lyses leads to an increased release of intracellular proteins and other intracellular materials. After the partial lyses, the partially lysed cell suspension is blended back into the ferment and cellular solids are again removed by centrifugation. The supernatant, containing the protein component, is then recovered.

In another embodiment, fresh live *Saccharomyces cerevisiae* is added to a jacketed reaction vessel containing methanol-denatured alcohol. The mixture is gently agitated and heated for two hours at 60° C. The hot slurry is filtered and the filtrate is treated with charcoal and stirred for 1 hour at ambient temperature, and filtered. The alcohol is removed under vacuum and the filtrate is further concentrated to yield an aqueous solution containing the Live Yeast Cell Derivative stress proteins. This LYCD composition is then blended with water, surfactants and stabilizing agents and the pH adjusted to between 4.0 and 4.6 for long-term stability.

In another embodiment, the heat shock process in the preceding embodiments, includes several stages of agitating and heating, cooling and repeating the cycle, to increase the output of heat shock proteins.

In another embodiment, the LYCD is further refined so as to isolate the active proteins having a molecular weight preferably between 500 and 30,000 daltons, utilizing Anion Exchange Chromatography of the crude LYCD, followed by Molecular Sieve Chromatography. The refined LYCD is then blended with water, surfactants and stabilizing agents and the pH of the composition is then adjusted to between 4.0 and 4.6 to provide long-term stability to the compositions.

The foregoing descriptions provide examples of a protein component suitable for use in the compositions and methods described herein. These examples are not exclusive. For example, those of skill in the art will recognize that the protein component may be obtained by isolating suitable proteins from an alternative protein source, by biosynthesis of proteins, or by other suitable methods. The foregoing description is not intended to limit the term "protein component" only to those examples included herein.

Additional details concerning the fermentation processes and other aspects of the protein component are described in U.S. Pat. No. 7,476,529, entitled "Altering Metabolism in Biological Processes," which is hereby incorporated by reference herein in its entirety.

Other Ingredients

In certain embodiments, the compositions disclosed above comprise one or more of additional ingredients listed below.

In some embodiments, the compositions disclosed herein further comprise a neutralizer. In certain embodiments, the neutralizer comprises one or more of monoethanolamine (MEA), diethanolamine (DEA), or triethanolamine (TEA).

In some embodiments, the compositions disclosed herein further comprise a stabilizing agent, which can be a chelating agent. In some embodiments, the chelating agent is a phosphate or a salt of ethylenediamine tetraacetic acid (EDTA).

In some embodiments, the compositions disclosed herein further comprise a pH buffer. Buffers are well-known in the art and any buffer that is chemically compatible with the other ingredients in the mixture can be used.

In some embodiments, the pH of the composition is between 3 and 14. In some embodiments, the pH of the composition is between 3 and 9. In other embodiments, the pH of the composition is between 3 and 5. In yet other embodiments, the pH of the composition is between 6 and 12. In yet other embodiments, the pH of the composition is between 6 and 8. In these embodiments, the composition can comprise a buffer or be without a buffer.

In some embodiments, the compositions disclosed herein further comprise a base. The base is preferably an inorganic base, but in some embodiments the base can be an organic base. The base is any substance that raises the pH of the solution. In some embodiments, the base is a hydroxide salt, which can be an alkaline or alkaline earth metal salt of the hydroxide ion, for example, sodium hydroxide, potassium hydroxide, magnesium hydroxide, calcium hydroxide, and the like.

In certain embodiments, a coupling agent is used to stabilize the compositions, especially when a protein mixture is added with surfactant to improve the cleaning performance by lowering interfacial tension. In some embodiments, propylene glycol or hexylene glycol is the coupling agent for its low toxicity and effectiveness.

Methods of Use

In another aspect, disclosed herein are methods of removing baked-on, burnt-on, cooked-on, dried-on or charred organic food residues from a surface, the method comprising applying to the surface a mixture as disclosed above and repeating the application as necessary; whereby the organic food residue is substantially removed from the surface.

Those of skill in the art recognize that not all of the organic food residue will be removed after the first application of the presently disclosed, or in fact any other, cleaning solution. In fact, at times several applications of the cleaning solution and cleaning of the surface are required to clean the surface satisfactorily. As discussed elsewhere herein, the presently disclosed cleaning solutions are superior to those that are currently available on the market. They clean better after the first application so that less number of repeats is required to obtain a clean surface. Further, to clean a surface "satisfactorily" does not mean that all of the organic food residue must be removed. In some cases, when most of the organic food residue is removed, then the surface is "satisfactorily" cleaned. Therefore, to practice the methods disclosed herein, a perfectly clean surface need not be achieved, as long as the organic food residue is "substantially" removed, meaning that most of the organic food residue is removed from the surface.

In some embodiments, the surface to be cleaned belongs to a cooking utensil, cooking equipment, a deep fryer, a hood, an oven, a rotisserie, and cookware, and the like.

In some embodiments, the first, or sole step of a cleaning process involves applying the cleaning solution, for example by spraying, allowing time for the chemical to soften the baked-on residues. The time can range anywhere between immediately thereafter to about half an hour, typically about fifteen minutes. The residue is cleaned by wiping, scouring, scraping or combinations thereof to remove, soften, or reduce the amount of residue. A second step with detergent cleaning and/or rinse step can be used if applicable, for example in institutional ovens, rotisseries and cooking vats, especially those that have a built-in, semi-automatic recirculating wash mechanism to minimize the amount of labor it takes to clean ovens after use.

It was a surprise to find that, using the compositions disclosed herein, as the first of a two-step cleaning process in an institutional rotisserie oven, the cleaning process was simplified with regular use. The meat was cooked in the rotisserie oven throughout the day and the oven had to be cleaned at the end of each day. The internal surfaces of the rotisserie were covered with baked-on residues that varied from being relatively soft and caramelized in appearance to a blackened carbonized consistency. The latter was the more difficult to remove. After repeated use of the composition disclosed herein in a manual cleaning of the two-step cleaning process, with cleaning being done once per day, after only a few days the amount of carbonized residue build-up was significantly reduced on subsequent days of using of the rotisseries. Most of the baked-on residues were limited to the consistency of the softer caramelized type, which were cleaned much more easily. This simplified the cleaning process by reducing the amount of manual abrasion that had to be applied in the first step of the two step process.

Additional Embodiments

In some embodiments, once the cleaning liquor flows down the drain and the sewer system, the stress proteins continue to work by uncoupling metabolic processes of microbes in the drains and sewer systems, where the wastewater treatment process can be thought of as starting at the point of the cleaning process. The applications listed above are not limiting and the compositions disclosed herein can be used in other related areas.

Compositions of hydrogen peroxide and alcohol, in particular benzyl alcohol, have been used in cleaning and disinfectant compositions and processes. In most instances where this combination is employed, a surfactant is used and the pH is buffered to desired levels typically above 12. Traditional cleaning solutions have not been very effective at cleaning or removing oils at neutral or relatively mild acidic conditions. For example, with traditional cleaners, the high pH levels saponify oils, which creates soaps as a by-product and can improve cleaning somewhat. In addition, alkaline conditions do not promote the formation of a protective oxide layer on metal surfaces such as stainless steel and can actually be detrimental. Acidic solutions and those comprising peroxy compounds are known to passivate and protect metal surfaces from corrosion. The passivated surface was surprisingly found to create an anti-deposition effect with baked-on residues, especially on stainless steel surfaces.

Certain of the compositions disclosed herein are particularly effective in automatic and semi-automatic wash systems that are used in institutional and industrial cooking equipment. Due to a high amount of agitation, these automatic systems can be prone to foaming and low foaming cleaning agents are desirable. The surfactant system is preferably a surfactant and a supernatant from a fermentation that contains stress proteins, where the protein/surfactant system improves wetting and penetration of the cleaning solution by lowering interfacial tension. In addition, as noted in other patents and patent applications owned by the Assignee, for example, U.S. Pat. Nos. 6,699,391, 7,165,561, 7,476,529, 7,645,730, 7,658,848, and 7,659,237, and U.S. Patent Application Publications Nos. U.S. 2006/0201877, U.S. 2008/0167445, and U.S. 2009/0152196, the entire disclosure of all of which is hereby incorporated by reference herein, the protein/surfactant systems breaks down a portion of oils into surface active agents, and these can add to foaming in a highly agitated wash cycle. Hydrogen peroxide is preferably the anti-deposition agent because it also improves the cleaning efficiency and acts as an anti-foaming agent by breaking down the oils.

The baked-on residues and oils to be cleaned by compositions disclosed herein are cured at high temperatures, as in ovens and rotisseries, and cooked repeatedly in many instances, making them much more difficult to remove. This is distinguishable from the cleaning of paints and varnishes, which are special polymers that are designed to cure at ambient temperatures after volatile components have evaporated. Paint and varnish can start to bubble after exposure to the formulations disclosed in several of the patents discussed above. Baked-on residues and oils do not exhibit such an observable phenomenon. Without manual abrasion of a baked-on food residue after spraying, the effects of the compositions disclosed herein generally do not exhibit a "bubbling" of the residue. The compositions disclosed herein soften the residues, however, to where they can be more readily removed.

Some of the compositions disclosed herein are based on using relatively mild compositions, and are designed to maintain the cleanliness of cooking equipment by preventing the build-up of baked-on residues besides working as a cleaner of existing baked-on residues. While the current compositions are effective in removing baked-on residue, these compositions can also be used to maintain cleanliness once the cooking equipment is cleaned of baked-on residue. The removal of baked-on residues may require the use of strong cleaning compositions. These can include the use of high pH caustic cleaners or oxidizing cleaners to remove a build-up of baked-on residues. Once the system has been cleaned, however, the use of the compositions disclosed herein can drastically reduce the need for such harsh cleaners with continued use of the compositions that incorporate the anti-deposition agents.

To reduce the amount of packaging material and the cost of shipping product, the compositions disclosed herein are based on solutions that can be made in a concentrated form, to be diluted at the point of use.

Rotisseries are difficult to clean due to the amount of food oils and other residue that splatter onto the internal surfaces of the equipment that are subsequently heated to high temperatures, many times with repeated cooking cycles. The heat of the cooking process bakes on the splattered residues, making them particularly difficult to remove. The baked-on residues are degraded to various degrees from lightly polymerized oils to caramelized substances to black carbonized residues, which are the most difficult to remove. Even with strong cleaning solutions, as those based on caustics and/or solvents, the residues are typically not completely removed without manual cleaning or some type of mechanical abrasion. A second, detergent wash cycle may be used. A final rinse is desired, to remove any cleaning solution from the equipment.

Without being bound to any particular theory, it is speculated that the reduction in the formation of carbonized deposits is related to the modification of stainless steel surface, possibly, in the manner characteristic for anti-corrosion passivation of stainless steel due to selective oxidative depletion of more active iron thus enriching the thin surface film with oxides of less active elements in stainless steel. This, in turn, prevents the formation of carbides, catalytic carbonization of organic material and adhesion of thus formed carbonized material to the metal surface. The cleaning compositions disclosed herein act to modify the stainless steel surfaces. Addition of hydrogen peroxide is preferred as it provides the additional benefit of improving the cleaning effectiveness.

Hydrogen peroxide is known to be able to reduce deposition on stainless steel. For example, U.S. Pat. No. 3,890,165 teaches that deposition on stainless steel surfaces can be reduced with polyphosphoric acid-based compositions to protect hydrogen peroxide from reacting and losing its potency for storing in stainless steel containers. U.S. Pat. No. 5,306,355 relates to use of oxygen (air) and a secondary agent such as hydrogen peroxide to reduce deposition on metal surfaces. International Patent WO/2001/049899 discloses that phosphoric acid and hydrogen peroxide compositions reduce deposition and brighten particularly iron and steel and uses organic substances to preserve the stability of the hydrogen peroxide in the bath.

Iron may act to catalyze carbonization of hydrocarbons. Some embodiments of the current invention use hydrogen peroxide to react, or reduce deposition, and create an oxide layer on the stainless steel surface, thus eliminating the catalytic free iron that would otherwise catalyze the carbonization reaction of the organic residues. To those skilled in the art of using cast iron cooking utensils, a carbonized surface on a skillet or pan is intentionally developed in order to protect the underlying iron from acidic food ingredients and acts as an anti-stick coating. U.S. Pat. No. 2,552,347 discloses creating synthetic hydrocarbons from carbon oxides with iron catalysts. The catalysts carbonize during the synthesis reaction, that is, to form fixed carbon or coke-like catalyst deposits, which cannot be readily removed by conventional method.

It is well known, particularly in corrosion science, that conditioning of the stainless steel surface with certain agents containing oxidants results in the formation of a very thin, invisible to the naked eye, but robust, uniform film of metal oxides, or phosphates, or some other solid, chemically inert surface compounds, that protect metal from further corrosion and alter its affinity to contaminants.

The physical reason of such an alteration of surface properties may be rationalized in terms of the force field acting on the surface metal atoms. Chemical potential (activity) of a surface atom depends on its local surrounding, especially on the shape of the local relief. An atom located at the top of a "hill," on the sharp edge of a dislocation, or in any other structural "defect" is more active and more inclined to bind other species from the vapor, or liquid phase, and then enter a chemical transformation involving ingredients of those vapors or liquids, as compared to an atom amidst a flat, defect-less surface.

It may be added, that the surface metal atoms in an unbalanced force field (i.e. in structural defects) may well serve as centers of adhesion and catalysts of the partial pyrolysis resulting in caramelization and carbonization, with a formation of iron-carbon, carbide-like surface compounds that further facilitate adhesion of organics. Eventually, that results in a conversion of the surface-bound organic contaminants into a hard-to-remove partially carbonized coatings.

Besides the textural features, the chemical composition of the surface layer (to the depth of about 50 to 2000 atoms) may substantially differ from the composition of the bulk metal. For instance, stainless steel typically contains chromium, nickel, manganese, and silicon. The surface layer is especially enriched with silicon.

Taking into account that the surface film is enriched in silicon, and that silicon is a major component rendering the surface of stainless steel resistant to further corrosion, while being insensitive to acids, it is likely that extensive treatment with alkali, though it may help to remove certain organic contaminants, such as caramelized sugars and/or carbonized fats, may be harmful for the properties of the steel surface, since silicon is known of being unstable in alkaline media and may be etched out by alkali. That, in turn, may lead to formation of caverns, other structural irregularities, thus increasing the chemical potential of the surface.

There is no comprehensive theory that would predict which composition will provide a robust, uniform, and chemically inert stainless steel surface. Therefore, the search for compositions and treatment regimens appropriate for every application is still pretty much a matter of trial and error.

The non-trivial observation, that washing with a protein/surfactant product containing hydrogen peroxide results in prevention of caramelization and carbonization of the splashed fat on the surface, is an indication of such a finding, and rationalized in the abovementioned context.

Namely, treatment with the compositions disclosed herein combines the advantages of a highly oxidizing environment created by hydrogen peroxide, resulting in the formation of a protective passive film, with that of a very effective surfactant system. The latter, besides the usual cleaning of hydrophobic contaminants, assists in supplying the oxidant to all the hidden micro-irregularities of the surface, thus improving its texture.

In one aspect, disclosed herein are specialized yeast fermentation products, which contain bio-active products. The bio-active products include an 'uncoupling' agent(s), the protein system comprised largely of yeast fermentation-derived low molecular weight stress proteins. It was previously found by the assignee that these proteins form tight complexes with surfactants and in this form act as uncouplers of bacterial oxidative phosphorylation. Uncoupling results in inhibition of the growth of bacterial biomass (thus preventing the formation and assisting in removal of biofilms, among other effects) while at the same time enhancing biooxidation of nutrients, including organic contaminants.

An uncoupler simply dissociates the electron transfer (biooxidation) process from the formation of ATP, lifting the kinetic control of the electron transfer by the transmembrane proton gradient as the intermediate step in ATP formation.

Since the protein systems disclosed herein are stable after exposure to the typical cleaning conditions, they keep exerting their effect upon natural microflora, in areas such as drains, sewers and septic systems where pH levels tend to be neutralized somewhat due to dilution. After mechanical application procedures such as wiping and cleaning are done, functionality is maintained and the protein systems keep on working as in other conditions described herein. Without being bound by any particular theory, it is presumed that the functionality is mostly due to the uncoupling where the natural microflora work to break down organic contaminants including biofilms. Without the protein system, the rate of organic degradation is not sufficient to prevent build-up. With the addition of the protein component the overall process can be viewed as starting the wastewater treatment process at the point of cleaning.

A feature that affects the rate and/or efficiency of a chemical process is the surface energy between two or more chemical surfaces, be they liquid-liquid or solid-liquid. Surface energy between two substances is measured as interfacial tension (IFT), and is a function of the two substances. The lower the IFT, the more easily the two surfaces can come into contact. Contact between the two surfaces is a prerequisite for a chemical reaction across the two surfaces to occur. Once the reactants meet, other factors, such as pH, emulsification qualities, reaction energies, temperature, critical micelle concentration, and the like, come into play to affect the rate of chemical reactions.

Typically, a cleaning solution is designed to lower the IFT between the cleaning solution and the "dirt" layer, normally an oily surface, to allow the cleanser within the cleaning solution to come into contact with various components in the "dirt" layer and affect the cleaning. For this reason, most cleaning solutions comprise a surfactant that lowers the IFT.

In many instances, to maximize cleaning efficiency, especially to be effective in removing oily and greasy soils, a high alkaline or high pH solution is useful. See, for example, U.S. Pat. Nos. 6,025,316, 6,624,132, 7,169,237, and U.S. Patent Application Publication No. 20030078178, all of which are incorporated by reference herein in their entirety. In some industrial applications, such as textile cleaning, the sizing agents are removed by cleaning solutions that can exceed a pH of 10. In paper and pulp processing high pH conditions are needed in several steps in the process. At the other end of the spectrum, it may be necessary to use solutions having lower pH, i.e., under acidic conditions, for use in applications such as removal of mineral scale deposits in bathrooms, industrial equipment, cooling systems and the like.

The compositions and methods are non-limiting in that they can be used in non-food related baked-on residues as well. Non-food applications may be limited, however, due to the fact that hydrogen peroxide can attack materials such as brass and other soft metals. In the food industry, stainless steel is widely used and is not negatively affected by the ingredients of the current invention.

Some examples of the cleaning compositions are as follows:

EXAMPLE 1

| Material | % |
|---|---|
| SURFONIC ® L12-6 Ethoxyleted Alcohol | 2.00% |
| SURFONIC ® L12-3 Ethoxyleted Alcohol | 4.00% |
| Dioctyl Sulfosuccinate | 3.00% |
| Hexylene Glycol | 6.00% |
| Protein Component | 20.00% |
| Hydrogen Peroxide (30% Active) | 25.00% |
| Triethanolamine | 0.75% |
| VERSENE ™ 100 EDTA | 1.50% |
| Water | 37.75% |
| TOTAL | 100.00% |

SURFONIC® L12-6 surfactant is the six-mole ethoxylate of linear, primary 10-12 carbon number alcohol. It is a water-soluble, nonionic surface active agent which is compatible with other nonionic surfactants and with most anionic and cationic surfactants. SURFONIC® L12-3 surfactant is the three-mole ethoxylate of linear, primary 10-12 carbon number alcohol. It is an oil-soluble, nonionic surface active agent which is compatible with other nonionic surfactants and with most anionic and cationic surfactants. SURFONIC® surfactants are available from Huntsman International LLC (www.huntsman.com).

VERSENE™ 100 is an aqueous solution of tetrasodium ethylenediaminetetraacetate. It is commercially available from the Dow Chemical Company (www.dow.com).

EXAMPLE 2

| Material | % |
|---|---|
| SURFONIC ® L12-6 Ethoxyleted Alcohol | 2.00% |
| SURFONIC ® L12-3 Ethoxyleted Alcohol | 4.00% |
| Dioctyl Sulfosuccinate | 3.00% |
| Hexylene Glycol | 6.00% |
| Protein Component | 20.00% |
| Hydrogen Peroxide (30% Active) | 25.00% |
| Triethanolamine | 1.00% |
| VERSENET ™ 100 EDTA | 1.50% |
| Water | 37.50% |
| TOTAL | 100.00% |

EXAMPLE 3

| Material | % |
|---|---|
| SURFONIC ® L12-6 Ethoxyleted Alcohol | 2.00% |
| SURFONIC ® L12-3 Ethoxyleted Alcohol | 4.00% |
| Dioctyl Sulfosuccinate | 3.00% |
| Hexylene Glycol | 8.00% |
| Protein Component | 20.00% |
| Hydrogen Peroxide (30% Active) | 25.00% |
| Triethanolamine | 1.00% |

-continued

| Material | % |
|---|---|
| VERSENE ™ 100 EDTA | 1.50% |
| Water | 35.50% |
| TOTAL | 100.00% |

EXAMPLE 4

| Material | % |
|---|---|
| SURFONIC ® L12-6 Ethoxyleted Alcohol | 2.00% |
| SURFONIC ® L12-3 Ethoxyleted Alcohol | 4.00% |
| Dioctyl Sulfosuccinate | 3.00% |
| Hexylene Glycol | 10.00% |
| Protein Component | 20.00% |
| Hydrogen Peroxide (30% Active) | 25.00% |
| Triethanolamine | 1.00% |
| VERSENE ™ 100 EDTA | 1.50% |
| Water | 33.50% |
| TOTAL | 100.00% |

EXAMPLE 5

| Material | % |
|---|---|
| Benzyl Alcohol | 66.60% |
| Propylene Glycol | 16.70% |
| Hydrogen Peroxide 27% | 16.70% |
| TOTAL | 100.00% |

EXAMPLE 6

| Material | % |
|---|---|
| Benzyl Alcohol | 65.60% |
| Propylene Glycol | 16.70% |
| Hydrogen Peroxide 27% | 16.70% |
| Dioctyl Sulfosuccinate | 1.00% |
| TOTAL | 100.00% |

EXAMPLE 7

| Material | % |
|---|---|
| Benzyl Alcohol | 65.10% |
| Propylene Glycol | 16.70% |
| Hydrogen Peroxide 27% | 16.70% |
| Protein Component | 1.00% |
| Dioctyl Sulfosuccinate | 0.50% |
| TOTAL | 100.00% |

EXAMPLE 8

| Material | % |
|---|---|
| Benzyl Alcohol | 63.60% |
| Propylene Glycol | 16.70% |
| Hydrogen Peroxide 27% | 16.70% |
| Protein Component | 2.00% |
| Dioctyl Sulfosuccinate | 1.00% |
| TOTAL | 100.00% |

EXAMPLE 9

| Material | % |
|---|---|
| Benzyl Alcohol | 59.10% |
| Propylene Glycol | 16.70% |
| Hydrogen Peroxide 27% | 16.70% |
| Protein Component | 5.00% |
| Dioctyl Sulfosuccinate | 2.50% |
| TOTAL | 100.00% |

EXAMPLE 10

| Material | % |
|---|---|
| Water | 31.75% |
| Protein Component | 20.00% |
| DEQUEST ® D2010 | 2.00% |
| NaOH 50% | 1.75% |
| Hexylene Glycol | 9.00% |
| Sodium Xylene Sulfonate 40% | 4.00% |
| Hydrogen Peroxide 35% | 22.50% |
| SURFONIC ® L12-6 | 3.00% |
| SURFONIC ® L12-3 | 3.00% |
| CHEMAX ® DOSS-75E | 3.00% |
| TOTAL | 100.00% |

DEQUEST® D2010 is the trade name for 1-hydroxyethylidene-1,1,-diphosphonic acid, available from Dequest AG (www.dequest.com). CHEMAX® DOSS-75E is a surfactant available from PCC-Chemax, Inc. (www.pcc-chemax.com).

EXAMPLE 11

| Material | % |
|---|---|
| Deionized Water | 82.00% |
| Protein Component | 3.35% |
| DEQUEST ® D2010 | 0.50% |
| NaOH 50% | 0.45% |
| Hexylene Glycol | 2.00% |
| Sodium Xylene Sulfonate 40% | 4.00% |
| Hydrogen Peroxide 35% | 5.70% |
| SURFONIC ® L12-6 | 1.00% |
| SURFONIC ® L12-3 | 0.50% |
| CHEMAX ® DOSS-75E | 0.50% |
| TOTAL | 100.00% |

EXAMPLE 12

| Material | % |
|---|---|
| Water | 25.77% |
| EDTA 40% | 1.00% |
| Monoethanolamine | 2.30% |
| Protein Component | 15.38% |
| Hexylene Glycol | 5.77% |
| Propylene Glycol | 23.10% |
| TOMADOL ® 91-6 | 4.61% |
| TOMADOL ® 91-2-5 | 4.61% |
| CHEMAX ® DOSS 75-E | 4.61% |
| Benzly Alcohol | 12.85% |
| TOTAL | 100.00% |

TOMADOL® 91-6 is a nonionic surfactant made from linear $C_{9-11}$ alcohol with 6 moles (average) of ethylene oxide. TOMADOL® 91-2-5 is a nonionic surfactant made from linear $_{C9-11}$ alcohol with 2.7 moles (average) of ethylene oxide. They are available from Air Products and Chemicals, Inc. (www.tomah3.com).

Examples were tested on an automatic cleaning rotisserie oven, constructed of stainless steel, where chickens were being cooked. Ovens were pre-cleaned to remove heavy baked on grease, oil and sugar. Tests were conducted over a three-day period with ease of removal of burnt-on grease and sugars, rinse-ability of the product, and the ability to inhibit the formation of carbonization and caramelization were evaluated against standard, high pH (13.5-14.0) caustic cleaners based on sodium hydroxide or potassium hydroxide are commonplace in the industry.

Subsequent cooking/cleaning cycles indicate that the cleaning process becomes easier to accomplish as time goes by. An additional benefit was observed in that the product is easily rinse-able, unlike the caustic cleaners that leave a white, powder adhering to the surface.

What is claimed is:

1. A method of reducing the formation of carbonization and caramelization of organic food or oil residues on a surface, the method comprising:

prior to cooking over the surface, applying to the surface a composition comprising:

at least one surfactant;

an anti-deposition agent selected from the group consisting of hydrogen peroxide, citric acid, acetic acid, phosphoric acid, sulfuric acid, and a combination thereof; and a protein component comprising yeast proteins and polypeptides selected from the group consisting of heat shock proteins and polypeptides; and stress proteins and polypeptides; wherein the yeast proteins and polypeptides are obtained from fermenting yeast cells and subjecting a mixture obtained from the yeast fermentation to stress;

subsequent to cooking over the surface, cleaning the surface with the composition; and repeating the application;

whereby the formation of carbonization and caramelization of organic food or oil residue on the surface is reduced.

2. The method of claim 1, wherein the at least one surfactant comprises a nonionic surfactant or an anionic surfactant.

3. The method of claim 1, wherein the at least one surfactant is selected from the group consisting of a C9-C11 or C10-C12 alcohol with 6moles ethylene oxide, a C9-C11 alcohol with 2.5 moles ethylene oxide, a C10-C12 alcohol with 3 moles ethylene oxide , and dioctyl sulfosuccinate.

4. The method of claim 1, wherein the surfactant comprises a total surfactant concentration of from about 1% by weight to about 20% by weight.

5. The method of claim 1, further comprising a neutralizer.

6. The method of claim 5, wherein the neutralizer comprises one or more of monoethanolamine (MEA), diethanolamine (DEA), or triethanolamine (TEA).

7. The method of claim 1, wherein the protein component comprises the product of a fermentation of yeast cells in the presence of a nutrient source.

8. The method of claim 7, wherein the yeast cells comprise one or more of *saccharomyces cerevisiae, kluyveromyces marxianus, kluyveromyces lactis, candida utilis, zygosaccharomyces, pichia*, or *hansanula*.

9. The method of claim 7, wherein the nutrient source further comprises one or more of a sugar, diastatic malt, diammonium phosphate, magnesium sulfate, ammonium sulfate zinc sulfate, and ammonia.

10. The method of claim 1, wherein the stress is selected from the group consisting of heat stress, chemical stress, and mechanical stress.

11. The method of claim 1, further comprising a chelating agent.

12. The method of claim 1, further comprising a base.

13. The method of claim 1, further comprising a pH buffer.

14. The method of claim 1, having a pH between 3 and 14.

15. The method of claim 1, wherein the anti-deposition agent is hydrogen peroxide.

16. The method of claim 1, wherein the anti-deposition agent is present in a concentration of between 0.01% to 12%.

17. The method of claim 1, wherein the anti-deposition agent is present in a concentration of between 4% to 8%.

18. The method of claim 1, wherein the surface is a steel surface.

19. The method of claim 1, wherein the surface is selected from the group consisting of a cooking utensil, cooking equipment, a deep fryer, a hood, an oven, a rotisserie, and cookware.

* * * * *